United States Patent [19]

Pearson et al.

[11] 4,163,580

[45] Aug. 7, 1979

[54] PRESSURE SWING RECOVERY SYSTEM FOR MINERAL DEPOSITS

[75] Inventors: Durk J. Pearson, Palos Verdes Estates; Jack R. Bohn, Rancho Palos Verdes, both of Calif.

[73] Assignee: TRW Inc., Redondo Beach, Calif.

[21] Appl. No.: 853,661

[22] Filed: Nov. 21, 1977

Related U.S. Application Data

[63] Continuation-in-part of Ser. No. 741,637, Nov. 15, 1976, Pat. No. 4,059,308.

[51] Int. Cl.[2] ..... E21B 43/28; E21B 43/25

[52] U.S. Cl. ..... 299/5; 299/14; 166/249

[58] Field of Search ..... 299/4, 5, 14; 166/249

[56] References Cited

U.S. PATENT DOCUMENTS

| | | | |
|---|---|---|---|
| 2,918,126 | 12/1959 | Bodine | 166/249 |
| 3,048,226 | 8/1962 | Smith | 166/249 X |
| 3,273,640 | 9/1966 | Huntington | 166/272 X |
| 3,759,574 | 9/1973 | Beard | 299/4 |
| 3,952,800 | 4/1976 | Bodine | 166/249 |

*Primary Examiner*—Ernest R. Purser

*Attorney, Agent, or Firm*—Benjamin DeWitt; John J. Connors

[57] ABSTRACT

A process for the in-situ recovery of minerals from subsurface deposits comprises forming a gas-tight or self-sealing chamber and injecting into it a solvent which is pressure cycled over a predetermined period of time. This pressure cycling increases the mineral extraction efficiency by improving the dissolution of material contained in blind cracks in the underground formation.

26 Claims, 4 Drawing Figures

PRESSURE SWING RECOVERY SYSTEM FOR MINERAL DEPOSITS

REFERENCE TO RELATED APPLICATIONS

This patent application is a continuation-in-part of our prior copending United States Patent Application Ser. No. 741,637, filed Nov. 15, 1976, which is now U.S. Pat. No. 4,059,308. Some of the related techniques with which the present invention optionally may be used are described more specifically in the above-identified prior application.

BACKGROUND OF THE INVENTION

A major difficulty in prior art solution mining, especially when the formation mineral is horizontally layered or fractured, is stagnation of process fluids in blind cracks, fissures and extremities of the down-hole cavity. For optimum removal of mineral, it would be desirable to continuously contact the mineral surfaces with fresh solvent. Where a large portion of the cavity surface consists of the walls of dead-end fissures, it has been substantially impossible to avoid accumulation, in the fissures, of semi-saturated and stagnant solvent. In most prior art processes, such as the Frasch sulfur process, mineral is removed from only those formation surfaces that are closely adjacent a flowing stream of solvent. The process fluid in blind cracks becomes completely stagnant. The overall common result is early channeling of the formation, that is the development of undesirably large passages extending directly from the injection well to the production well and through which the process fluid circulates with an ever-decreasing mineral yield. In solution mining of nahcolite, the problem is compounded in that most of the nahcolite is found in predominantly horizontal stringers and horizontal beds of nodules embedded in a substantially impervious shale formation. While rubblizing has been used with some success as a means for pre-enabling solution mining, it merely alleviates the difficulty and does not enable an intimate non-stagnant contact between the mineral and the process fluids.

A primary principle of our invention is repeated liquid-to-vapor phase change of a solvent or a vaporizable component of a solvent mixture disposed in contact with in-situ minerals which are to be dissolved and extracted in solute and/or slurry form. The invention itself, its advantages, and the details for its optimum application in various environments will be best understood by considering the following exemplary implementations. It is to be understood, however, that our invention is not limited to these examples or any specific application, but may be used for the extraction of substantially any mineral that is soluble in an available solvent capable of being cyclically vaporized and condensed in response to controlled pressure variation over a predetermined pressure range. Alternatively, it is possible to use a solvent mixture containing a substance which can be cyclically evaporated and condensed or evolved (outgassed) and absorbed.

In the past, underground minerals, such as oil shale deposits, were mined and brought to the surface for further processing of the various components and constituents. Underground mining is expensive, time-consuming, and dangerous. Open pit mining of many mineral deposits is prohibited, economically, by thick overburden. In addition, ecological problems add to the costs associated with these methods of extraction.

One technique for in-situ processing of shale oil involves underground tunneling into the shale-oil deposits in a predetermined pattern for the purpose of blasting and rubblizing the deposit. After the deposit is rubblized, a flame front is instituted which causes an in-situ retorting of the hydrocarbon values in the shale. This process has met with limited success primarily because of difficulty in obtaining uniform rubble in the shale deposit with the attending problems of maintaining a reasonably uniform flame front and avoiding large plastic deformation and flow of the oil shale. If the rubble is not reasonably uniform, a substantially uniform flame front is not maintained, and the flames are quenched by the retorting products, or by-pass burning occurs. The plastic flow problems are particularly severe in kerogen-rich deposits.

Pressure fluctuation has been used in the past to improve recovery from conventional oil fields. In one process, steam pressure is cyclically varied (huff and puff) to recover viscous oil from sand and gravel. This prior art technique employs a pressure range such that condensation at the ambient temperature is avoided. Moreover, in the prior art, that technique normally is used only until the heated subsurface of two adjacent wells come into contact, and then it is replaced by continuous steam pressure drive. Moreover, the formations wherein "huff and puff" has been applied are essentially a mixture of heavy oil, sand, and gravel. They have neither the prominant horizontal layered structure nor the blind cracks commonly found in mineral deposits having economically attractive concentrations of nahcolite, dawsonite, or kerogen.

SUMMARY OF THE INVENTION

The present invention relates to pressure cycling of a selected solvent in an in-place process for extracting soluble minerals from mineral deposits such as kerogen-containing shale. This process can be used, for example, in conjunction with the process set forth in co-pending application Ser. No. 741,637, entitled "Recovery System for Oil Shale Deposits" by Hill, et al. This process employs cyclic pressure swings of the vapor of a solvent suitable for dissolution of a constituent of the mineral deposit. Generally, these pressure swings may have time periods of the order of one cycle per hour to one cycle per month and over a range from 35 to 75 percent of the lithostatic pressure in the mineral formation. Perhaps the most important consideration is that the average pressure should be near the boiling point of the solvent at the preferred operating temperature in the formation, and the cyclical pressure variations should be sufficient to successively vaporize and condense a substantial portion of the solvent.

It is to be observed that the optimum operating temperature may be as high as about 300° F. but, in some circumstances, may be the original temperature of the formation without artificial heating thereof. In the absence of pressure fluctuations, process fluids would become stagnant in the blind fractures or cracks, i.e., those fractures or cracks which are open only at one end. When the pressure is cycled between evaporation and condensation of the solvent, the solvent is forced into and drawn out of the blind fractures, introducing fresh processing solvent and extracting solute. Thus, the removal of dissolved minerals is greatly enhanced. This effect is most clearly visualized by considering the use of steam to remove a soluble mineral, such as nahcolite, from blind cracks in a mineral formation such as the Piceance Creek kerogen-containing shale deposits. When a blind crack is filled with pressurized steam, the steam condenses to stagnant water, saturated with soluble minerals. Under constant pressure conditions, leaching stops when the mineral content of the solute approaches saturation. If the pressure is reduced, some of the water in the crack will boil, thereby expelling the saturated water and making the crack accessible to fresh steam on the next pressure upswing. Thus, by cyclical variation of the applied pressure, a volatile solvent is caused to cyclically fill the blind crack condense, and dissolve mineral. Upon vaporization of a portion of the solvent, solute or a slurry mixed with solute is ejected from the crack thereby making room for inflow of a fresh supply of vapor.

DESCRIPTION OF THE PREFERRED EMBODIMENTS

Figure 1:
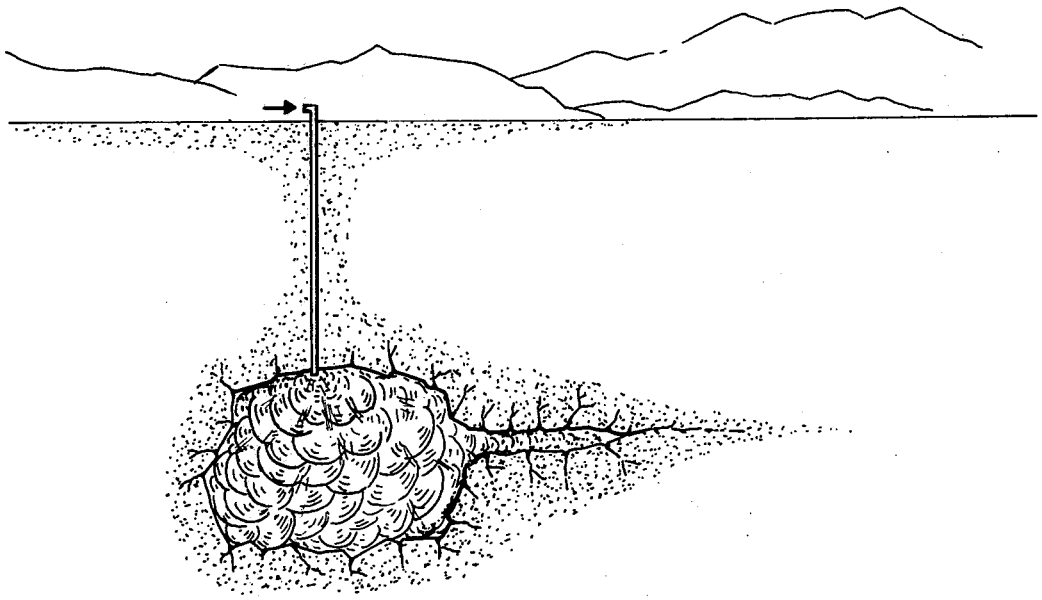
FIG. 1 shows the injection of a process fluid into an underground chamber having a blind fracture or crack extending from the chamber into the subsurface structure.

A currently preferred and exemplary embodiment of our invention is used to recover minerals, such as nahcolite, dawsonite, nordstrandite, shortite, trona, halite, hydrocarbon, and other valuable minerals from subsurface formations by pressure cycling of a working fluid between condensation and vaporization in-situ. Although the principles set forth in this process may be applicable to substantially any soluble mineral, it is best illustrated in its application to oil shale deposits such as those in the Piceance Creek Basin in northwestern Colorado. This specific mineral formation contains recoverable shale oil, nahcolite, and dawsonite spread over an area of about 300 square miles and approximately 900 feet in thickness. By employing an in-place process, the nahcolite is first extracted followed by kerogen recovery, then by alumina recovery and secondary oil recovery, and finally by tertiary recovery using in-situ combustion. An integrated process including all five of the foregoing steps is described and claimed in our co-pending U.S. patent application, Ser. No. 741,637, now U.S. Pat. No. 4,059,308, of which the present application is a continuation-in-part. In accordance with our present invention, an oversized hole is drilled into the gas-tight overburden which is then encased and grouted to form a gas-tight cavity at the bottom of the hole. The drill patterns may be in the form of individual wells or multiple wells. Where individual wells are used, a coaxial tubing is placed down the well hole, and fluids are injected into the hole through the outer pipe while products are extracted through the center tubing. In a multiple well pattern, a central injector well is placed in a particular location, and producer wells are located in the vicinity in any of a number of conventional patterns.

In the deep deposits of the Piceance Creek Basin, solution mining of nahcolite is desirable, initially, to provide access to the balance of the resource as well as for the market value of the nahcolite, per se. Thus, solvent removal of nahcolite from these deposits is an economically attractive and exemplary application of the principles of our present invention. Nahcolite is soluble in water and is decomposed by heat into sodium carbonate, carbon dioxide and water. Although the nahcolite occurs as nodules, veins, or disseminated crystals, these tend to be interconnected. To accomplish the nahcolite removal from the selected subsurface horizon, we inject hot water or preferably steam into the formation at the bottom of the completed borehole. Because considerable amounts of the nahcolite exist in blind fractures, i.e., fractures or cracks which are open only on one end, the cyclical vaporization/condensation concept of our present invention provides a highly advantageous method for repeatedly flushing these cracks and thereby accelerating dissolution of the nahcolite. Specifically, pressure cycling is employed to force condensible steam or hot water into the blind cracks and repeated expulsion of solute from the fracture or crack when the pressure is released. In this manner, saturated and stagnant solute is repetitively transported from the cracks and fissures to the sump at the bottom of the hole. When the pressure is increased, fresh steam is forced into the crack or fracture, and when the pressure is reduced, a solution of nahcolite is expelled from the crack or fracture by pressure-drop-induced boiling. The frequency of the cycle will depend upon the underground structure, the size of the cavity, the nature of the process fluids, and the thermal gradients desired. Generally, the optimum cycling frequency for a specific location will be in the frequency range from approximately one cycle per hour to one cycle per month. The optimum frequency of the pressure fluctuation will be determined in the field; however, in general, a cavity will be cycled faster when small rather than when large. The cycle frequency may, however, be as short as a few minutes during start-up in a relatively tight formation or for ongoing solution mining of very small cracks and fissures. Likewise, the amount of the pressure being applied will depend upon a number of factors, e.g., the depth of the chamber, the temperature of the chamber, etc. Generally, pressure swings over the range from 25% to 90% of the lithostatic pressure in the chamber are sufficient to force solvent in and out of substantially all the blind cracks and fractures. Accordingly, a semi-saturated pool of nahcolite-in-water solution collects in the pocket at the bottom of the hole, and may be extracted by substantially any conventional pumping technique. If desired, a surfactant, such as one of those described in our above-identified prior application, may be added to the working fluid to increase the mass-flow of material in and out of the blind cracks and veins. This may be especially useful for flushing large cracks and pockets formed by the dissolution of larger nodules. After creating porosity in the formation by leaching the water-soluble nahcolite from the shale zone, the leach-enlarged cavity may be pumped dry, and in-situ retorting of the shale may be conducted by the circulation of a hot fluid, such as heated low molecular weight hydrocarbon gas, steam, heated retort off-gas comprising $H_2$, CO, $CO_2$, $N_2$, and mixtures thereof, from the injection well through the permeable shale bed and out the producing well. The various steps subsequent to the present nahcolite extraction are described in full detail in our above-identified co-pending application and, since they are not essential to the present invention, are not described further herein.

Oil vapor from the decomposition of kerogen is cooled by the formation ahead of the retorting front and can be condensed and drained into a pocket from which it can be pumped along with some water from the dawsonite decomposition. The off-gas produced by the kerogen in the retorting process includes four components comprising the hot fluid used for retorting, the gas from the kerogen decomposition, oil vapors, and the carbon dioxide and water vapor from the dawsonite decomposition. If the gas from the kerogen decomposition is used as the heat carrier for retorting, the resulting off-gas will have a medium heating value after the removal of the water and $CO_2$. It will be recognized that the nahcolite solution mining and in-situ retorting, as described above, optionally may be followed by extraction of alumina and other steps, as described in the above-mentioned co-pending application.

The operation of our invention, in its use for extraction of nahcolite from kerogen-bearing oil shale, may be summarized as follows. First, a suitable solvent, e.g., steam, is injected by way of a conventional borehole into the nahcolite-containing deposit. As the steam condenses on the walls of the pocket at the hole bottom, nahcolite is dissolved and is pumped to the surface. Steam enters the predominately horizontal system of cracks and nahcolite stringers where, as the pressure is increased, the steam condenses on the walls of the cracks, dissolved nahcolite from such surfaces, and forms a pool of semi-saturated solution in the cracks. Condensation in the stringers and cracks carries heat energy thereto and gradually increases the temperature of the accessible formation to a desired level. When the injection pressure is decreased, part of the brine located in the cracks and stringers will flash into steam, thereby driving most of the brine into the pocket at the bottom of the hole from which it is removed by pumping. When the injection steam pressure is again increased, all of the accessible cracks and stringers are again filled with fresh vapor, and condensation occurs. Incremental condensation will occur first in those portions of the cracks and fissures having the lowest relative temperature and, as the pressure is increased, the condensation will extend to substantially all of the cracks until they are all at least partially filled with liquid. In addition to ordinary boiling, as the pressure is reduced, the flushing action is enhanced by cyclical decomposition and reconstitution of NA H $CO_3$. That is, $CO_2$ is evolved on each pressure down-swing and chemically recombined on each pressure up-swing. The cyclical pressure variation between vaporization and substantially complete condensation is cyclically repeated to thereby repetitively transport quantities of semi-saturated brine and slurry from the extremities of the cavity to the pocket at the bottom of the hole. The brine so collected in the well sump is removed by conventional pumping and processed on the surface to recover nahcolite and sodium carbonate as a product.

In the foregoing, we have described in detail the manner in which our invention is used in solution mining of nahcolite from kerogen-bearing shale formations. That exemplary use of our invention is economically attractive, not only because the sodium carbonate and sodium bicarbonate are readily marketable as commercial products, but also because solution mining of the nahcolite is a significantly improved method for preparing the kerogen-shale for subsequent in-situ processing. It is to be expressly understood, however, that our invention is not limited to solution mining of nahcolite or any other specific mineral. In the following, we describe, by way of example, the use of our invention in solution mining of several other valuable minerals.

In applying our invention to recovery of copper values from sulfite formations, such as chalcopyrite and chalcocite, we use leaching chemistry similar to that widely used heretofore for leaching broken ore in old mine dumps. We prefer to use a working fluid consisting of steam and dilute sulfuric acid. Specifically, we first drill a borehole in a conventional manner into the formation of interest. The drill hole is completed by installing casing and cementing it in place in accordance with practices commonly used in the oil industry. At the bottom of the hole, a pocket is created in the formation by blasting or hydrofracture to provide a downhole cavity consisting of a pocket at the hole bottom and a plurality of cracks and fissures extending from the pocket into the mineral formation generally as illustrated in FIG. 1. Preferably, the casing is cemented into the hole with sufficient integrity so that the pocket at the bottom of the hole constitutes a fluid-tight chamber into which the working fluid may be injected at superatmospheric pressures approaching the ambient rock pressure in the formation.

Steam is injected into the well in a sufficient quantity to heat the formation in the vicinity of the pocket to a temperature of at least about 225° F. to 300° F. The steam injection may be accomplished by the use of coaxial injection and production tubing as is usual in the oil industry. Alternatively, in the case of formations where there is relatively good fluid communication between horizontally spaced portions of the formation, it may be advantageous to use a single injection well surrounded by a plurality of radially spaced production wells from which the recovered product is pumped.

After the steam is injected, and the formation is raised to the desired temperature level, we inject dilute sulfuric acid in a sufficient quantity to bring the acid concentration in the well bottom pocket to about 0.05 to 1.0 weight percent $H_2SO_4$. In some formations, even lower acid concentrations are useable and, for very low grade ores, may be desirable in that acid activity is increased by the elevated temperature at which our process operates. When the downhole pressure is periodically reduced, the dilute sulfuric acid solution which occupies blind cracks and fissures in the formation is at least partially vaporized to drive copper sulfate solution from the extremities of the blind cracks toward the pocket at the bottom of the hole. By using a periodic pressure fluctuation within the range from 10 to 100 psia, the driving vapor pressure differential between the extremities of the blind cracks and the borehole bottom pocket may be as much as about 50 psia. By repetitively increasing and decreasing the borehole pressure over a range sufficient to repetitively condense a major portion of the working fluid and subsequently vaporize a portion of the working fluid, copper sulfate condensate is successively pumped from the blind cracks and extremities of the downhole cavity toward the pocket at the bottom of the hole.

Figure 2:
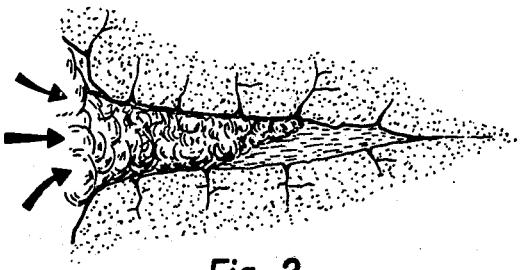
FIG. 2 is an enlargement of the blind fracture or crack showing the vapor of a solvent being driven under pressure into the cavity.
Figure 3:
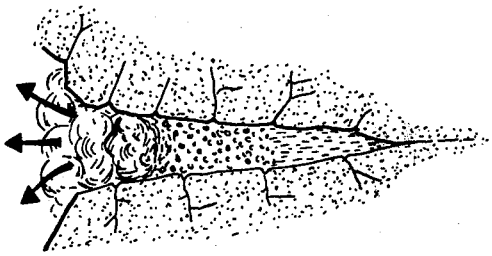
FIG. 3 is an enlargement of the blind fracture or crack showing mineral solute being ejected from the cavity as the pressure is reduced.
Figure 4:
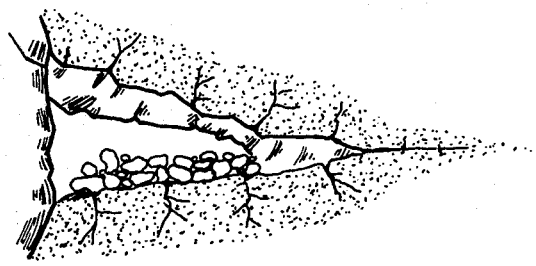
FIG. 4 illustrates the blind fracture or cavity after it has been enlarged by repeated phase-change pressure cycling of the condensable solvent.

In accordance with a variation of the foregoing copper recovery process, essentially the same end can be accomplished at lower temperatures by using a leaching fluid which is saturated with carbon dioxide at an elevated pressure. For operation in relatively very tight geological formations, pressures of up to about 75% of the ambient lithostatic pressure may be employed. More specifically, water substantially saturated with $CO_2$ is injected into the copper-sulfide formation with sufficient sulfuric acid being added so that the acid concentration at the working zone is of the order of one weight percent sulfuric acid. When the pressure in the downhole pocket is reduced, some of the carbon dioxide comes out of solution thereby generating gas pressure in the extremities of the blind cracks and fissures. This carbon dioxide gas pressure drives liquid leachate from the cracks and fissures toward the pocket at the bottom of the hole from which it may be pumped in accordance with conventional practice, as described above. Upon cyclical repressurization of the downhole pocket, the carbon dioxide gas in the blind cracks and fissures will redissolve in small portions of the dilute sulfuric acid solution and copper sulfate leachate remaining in the cracks. This redissolving of the $CO_2$ sharply reduces the gas volume in the blind cracks thereby permitting the flow of leaching solution from the injection tubing pocket into the cracks and fissures. The optimum period for each cyclical increase and decrease of the downhole pressure will depend on a variety of factors such as the characteristics of the copper ore, the ambient lithostatic pressure, and whether a single borehole is used both for injection and extraction of product. The illustrations in FIGS. 1 through 4 are equally representative of the application of our invention to solution mining of copper. That is, FIG. 2 illustrates the injection of steam and/or $CO_2$ with sulfuric acid into the fissures and cracks as the downhole pressure is increased. FIG. 3 shows the ejection of solute, e.g., copper sulfate, as the pressure in the well is reduced and the water in the cracks flashes into steam.

A further embodiment of our invention, suitable for extracting copper from formations containing substantial quantities of native copper in the presence of carbonate minerals, uses a pressure cycled leaching process generally as described in the foregoing but with the following differences. In recovering copper from these formations, the presence of carbonates precludes economic use of an acid leach, however, in-situ solution mining of such formations is subject to the same blind-crack difficulty as described in the foregoing paragraphs. Cyclical pumping of solution from the blind cracks in accordance with our invention enables removal of saturated leach solution from the blind cracks and successive filling of the blind cracks with fresh leach solution. In this embodiment, because use of an acid leach is uneconomical, we prefer to use a leaching reagent and leaching reaction which is, per se, known in the prior art. This leaching technique uses as a reagent a mixture of cuprous ammonium carbonate and ammonium hydroxide. The reaction at the surfaces of the blind cracks and fissures where native copper is present is:

$$\begin{array}{l} Cu + Cu \\ (NH_3)_2CO_3 + NH_4OH \rightarrow [Cu(NH_3)_2]_2CO_3 + 2H_2O \end{array}$$

This reaction in the downhole cracks and fissures extracts native copper from the formation, so that it is removable from the borehole in the form of a dilute solution of cupric ammonium carbonate. The desired pressure regime in the pocket at the bottom of the hole can be maintained by introducing the leaching solution with steam or, alternatively by saturating the leaching solution with excess carbon dioxide or ammonia gas at elevated pressures and operating the process substantially as described in connection with the earlier embodiments. After the leaching solution is pumped from the bore hole, it may be regenerated on the surface with air and carbon dioxide in accordance with well-known practice. For example, copper oxide may be recovered from the leach solution simply by boiling the solution. Alternatively, a counter-current chelate solvent extraction may be used and may be followed by electrowinning to recover the metallic copper. These alternative techniques for regenerating the leaching reagent at the surface are, per se, well known to persons skilled in the art.

The principles of our invention may also be used for solution mining of potassium ores. Specifically, potassium chloride, KCl, in the form of sylvite, often occurs in thin horizontal beds of large areal extent. In many cases, these mineral beds are subdivided and periodically pinched off by shale stringers to an extent such that well-to-well communication, as required by conventional multiple well techniques, cannot be practically achieved. Our invention enables solution mining extraction of sylvite by means of a single well, in even the extreme cases where the sylvite appears in isolated lenses or beds wholly surrounded by impervious shale. The cyclical pressurization and depressization using steam and water condensate for dissolving mineral is in this case substantially the same as described heretofore in connection with solution mining of copper ores. At typical formation pressure, sylvite has a solubility of about 30 to 40 grams per liter. By elevating the temperature of the formation to a working temperature within the range from about 200 to 300 degrees F., we achieve sylvite solubility within the range from 80 to 200 grams per liter of water. As described heretofore, when the pressure in the down-hole pocket is reduced, some of the hot water in the blind cracks flashes into steam and, because the formation is heated, further steam is produced from boiling directly at the surfaces of the formation in the blind cracks. When such boiling occurs in the blind cracks and at the extremities of fissures in the formation, a fine slurry of potassium chloride suspended in a water solution of potassium chloride is ejected from the blind cracks toward the down-hole pocket. The slurry and solution is pumped to the surface for processing in accordance with conventional practice. Because this pressure cycling process enables recovery of slurry as well as saturated solution, the capital and operating cost of a typical potassium chloride solution mining operation can be very substantially reduced. That is, for a given potassium chloride production rate, significantly smaller pumps, tubing, and evaporation ponds may be used. Again, in this cyclical pressurization for solution mining of potassium chloride, it is possible to use a water leaching solution saturated with carbon dioxide instead of using steam. We have found that the use of this carbon dioxide solution technique is advantageous where the lithostatic pressure at the formation is extremely high and it is desired to operate at ambient temperatures or at temperatures substantially below the boiling point of water at the ambient lithostatic pressure.

The principles of our present invention are also applicable to solution mining of uranium ores in sedimentary rocks which contain substantial quantities of carbonate minerals, such as the northern New Mexico sandstone-and-dolomite deposits. In this application, we use an aqueous solution of ammonium carbonate plus ammonium bicarbonate with hydrogen peroxide, $H_2O_2$, added as the oxidizer portion of the leaching solution. In this case, the pressure cycled leaching preferably is conducted at ambient or slightly elevated temperatures and, in other respects, is substantially as described heretofore in connection with the copper recovery processes. The desired repetitive pressure fluctuation can be generated thermally by injecting steam. As the down-hold pressure is increased, carbon dioxide (derived from the decomposition of ammonium bicarbonate as the temperature is increased) dissolves into the hot water to thereby enable increased quantities of leaching solution to flow into the cracks and fissures. During the pressure reduction phase of each successive pressurization cycle, uranium values in the form of hexavalent uranium compounds are dissolved in the leaching solution and ejected from the fissures and pores of the formation by the steam pressure generated therein. The usual carnotite derived uranium complexes are $(NH_4)_4UO_2(CO_3)_3$, $(NH_4)H\ U_2O_7$, and $(NH_4)_2U_2O_7$, all of which are relatively very soluble in water as compared to carnotite, per se. Thus, the dissolved mineral is carried from the extremities of the formation toward the pocket at the bottom of the hole and, as described heretofore, may be pumped to the surface for subsequent processing.

Again, where the uranium mineral, e.g., carnotite, is found in a formation having extreme lithostatic pressures, and it is desired to operate at temperatures somewhat less than the vaporization temperature of water at the ambient lithostatic pressure, cyclical expulsion of mineral from the pores and fissures of the formation may be accomplished by the use of a leaching solution saturated with carbon dioxide or ammonia. In accordance with this variation of the process, the fresh leaching solution, prior to injection into the well, is saturated with carbon dioxide or ammonia at pressures substantially equal to the ambient lithostatic pressure. To achieve successive and repetitive absorption and evolution of carbon dioxide from the leaching solution, the downhole pressure is preferably cycled over a pressure range from about 35 percent to 75 percent of the ambient lithostatic pressure in the formation. Where geologically feasible and legally permissible, it may be advantageous to use a pressure range from about 25% to 90% of lithostatic. In all other respects the pressure cycling process may be the same as described heretofore in connection with the other exemplary embodiments.

While we have described our invention by setting forth the details of its application to a few specific minerals only, it is to be understood that our invention is not limited to these specific minerals. We recognize that various modifications and permutations of the basic principles of our invention will become apparent to those skilled in the art, and it is intended that the appended claims shall encompass all such modifications and permutations as fall within the true spirit and scope of our invention.

We claim:

1. In a process for the recovery of minerals from a subterranean mineral deposit which includes at least one soluble mineral, the steps of:
(a) drilling at least one borehole through which fluids may be introduced into said deposit;
(b) introducing into said borehole a quantity of a predetermined solvent suitable for dissolving said mineral;
(c) cyclically varying the pressure in said borehole over a sufficient pressure range to repetitively vaporize and condense at least a substantial portion of said solvent so that vaporization of said solvent in the pores and cracks of said deposit is effective to drive solute out of the pores and cracks; and
(d) extracting a solution of said mineral from said mineral deposit.

2. The process of claim 1 in which:
(a) said mineral deposit includes nahcolite;
(b) said solvent is water introduced as steam; and
(c) said steam is injected into said mineral deposit at varying pressure cycled with a predetermined periodicity to dissolve and extract, by cyclical condensation and vaporization, portions of the nahcolite located in the extremities of cracks and fissures of the mineral deposit.

3. The process of claim 2 where said mineral deposit is a kerogen-containing shale having distributed nahcolite nodules and stringers.

4. The process of claim 2, where the pressure is varied relative to the average borehole-bottom lithostatic pressure over a range from about 35 to 75 percent.

5. The process of claim 1 in which said mineral deposit is a deeply bedded kerogen-containing shale having distributed therein associated minerals selected from the group consisting of nahcolite, dawsonite, nordstrandite, shortite, trona, and halite.

6. The process of claim 1 wherein:
(a) said mineral is a copper sulfide ore;
(b) said solvent consists essentially of steam and dilute sulfuric acid; and
(c) the solution extracted from said mineral deposit is primarily copper sulfate dissolved in water.

7. The process of claim 6 wherein steam is injected in a sufficient quantity to heat the mineral deposit in the vicinity of the bottom of the borehole to a temperature of at least 225° F.

8. The process of claim 1 wherein:
(a) said mineral is a copper sulfide ore;
(b) said solvent is a dilute solution of sulfuric acid saturated with dissolved $CO_2$ at an elevated pressure of the order of 50 to 75 percent of the ambient lithostatic pressure at the bottom of the borehole.

9. The process of claim 1 where:
(a) said mineral deposit consists essentially of potassium chloride in the form of sylvite disposed in relatively thin horizontally extended layers;
(b) said solvent consists of steam and water injected at elevated temperature and a pressure approaching the downhole lithostatic pressure; and
(c) the mineral solution extracted consists essentially of a slurry of KCl carried in a substantially saturated aqueous solution of KCl.

10. The process of claim 1 wherein said solvent consists essentially of water substantially saturated with dissolved carbon dioxide at ambient temperature and an elevated pressure within the range from 20–80 percent of the downhole lithostatic pressure.

11. The process of claim 1 wherein:
(a) said mineral deposit includes a substantial concentration of kerogen;
(b) said solvent is water injected in the form of steam at a pressure between 35% and 75% of the average down-hole lithostatic pressure in said mineral deposit; and
(c) the down-hole pressure is cyclically varied over a pressure range from at least 25 percent to at most about 90 percent of the down-hole lithostatic pressure.

12. The process of claim 11 wherein the down-hole pressure is varied at a frequency within the range from one cycle per hour to one cycle per month.

13. The process of claim 1 wherein:

(a) said mineral deposit is a uranium ore;

(b) said solvent is an aqueous solution of ammonium carbonate and ammonium bicarbonate; and (c) the pressure in said borehole is cyclically varied by injecting into said borehole at varying injection pressures a fluid selected from the group consisting of steam, $CO_2$, and a mixture of steam and $CO_2$.

14. The process of claim 1 wherein said predetermined solvent is superheated steam or a saturated aqueous solution of $CO_2$ injected at a pressure substantially corresponding to the downhole lithostatic pressure within said mineral deposit.

15. In a process for the recovery of valuable minerals from a subsurface formation which includes hydrocarbon compounds and at least one inorganic mineral, the steps of:

(a) drilling into said formation to provide a hole through which fluids may be introduced into and removed from said formation;

(b) forming a gas-tight cavity in said formation at the bottom of said hole;

(c) introducing into said cavity a quantity of a solvent suitable for dissolving said inorganic mineral;

(d) vaporizing at least a substantial portion of said solvent;

(e) repetitively varying the pressure in said cavity over a sufficient pressure range to cyclically vaporize and condense a substantial portion of said solvent and thereby promote dissolving of said inorganic mineral; and (f) physically extracting to the surface hydrocarbon fluids and a solution of said inorganic mineral.

16. The process of claim 15 in which said formation is a kerogen-bearing shale, said solvent is superheated steam, and the inorganic mineral is nahcolite.

17. The process of claim 15 in which a substantial portion of said solvent is vaporized by heating said cavity to a temperature approaching the boiling point of said solvent at the ambient downhole lithostatic pressure.

18. The process of claim 15 where said formation is a kerogen-bearing shale, and the inorganic mineral is nahcolite distributed in stringers and nodules throughout a substantial portion of said formation.

19. The process of claim 18 where:

(a) extraction of said nahcolite from cracks, fissures and veins in the formation increases the porosity of the formation; and (b) hydrocarbon compounds are subsequently extracted by circulation of a heated gas through permeable portions of the formation.

20. The process of claim 19 where said heated gas is selected from the group consisting of:

low molecular weight hydrocarbon gas, $H_2$, CO, $CO_2$, $N_2$, steam, and mixtures thereof.

21. The process of claim 15, where the pressure in said cavity is varied over a pressure range from about 25 to 90 percent of the downhole lithostatic pressure.

22. The process of claim 15 where the pressure is varied relative to the ambient lithostatic pressure over a range from about 35 to 75%.

23. The process of claim 15 where said formation is a deeply-bedded kerogen-containing shale having distributed therein associated minerals selected from the group consisting of nahcolite, dawsonite, nordstrandite, shortite, trona, and halite.

24. The process of claim 15 where dissolution of said inorganic mineral increases the porosity of the formation in the vicinity of the borehole and thereby facilitates extraction of said hydrocarbon compounds.

25. A process in accordance with claim 14 and further including the steps of:

(a) drilling a plurality of production wells into said formation in a predetermined pattern around and spaced from the first hole;

(b) cyclically varying the pressure at which solvent is injected into the first hole until permeability of the formation between said first hole and several of said production wells is established; and (c) thereafter injecting a heated gas into said first hole and through permeable portions of the formation to thereby increase the recovery of hydrocarbon compounds from several of said production wells.

26. In a method of producing hydrocarbons from a subterranean formation which includes a hydrocarbon-rich mineral and a hydrocarbon-poor inorganic mineral, the steps of:

(a) penetrating a borehole into said formation;

(b) injecting into said formation a solvent selected for dissolving said inorganic material;

(c) maintaining the temperature of said solvent in said formation near the temperature at which said solvent changes from its liquid-phase to its vapor-phase under a pressure corresponding substantially to the ambient rock pressure; and (d) cyclically varying the applied fluid injection pressure over a pressure range sufficient to cyclically vaporize solvent which has penetrated the pores of said formation and thereby accelerate leaching of said inorganic mineral.

* * * * *